US007971452B2

(12) United States Patent
Rydlewicz

(10) Patent No.: US 7,971,452 B2
(45) Date of Patent: Jul. 5, 2011

(54) TRIANGULAR SHAPED DIAMOND WHICH DISPLAYS HEARTS AND ARROWS PATTERN

(75) Inventor: Roni Rydlewicz, Brussels (BE)

(73) Assignee: Worldwide Diamond Trademarks Ltd. (CA)

( * ) Notice: Subject to any disclaimer, the term of this patent is extended or adjusted under 35 U.S.C. 154(b) by 165 days.

(21) Appl. No.: 11/744,550

(22) Filed: May 4, 2007

(65) Prior Publication Data

US 2008/0271485 A1 Nov. 6, 2008

(51) Int. Cl.
*A44C 17/00* (2006.01)

(52) U.S. Cl. ..... 63/32; D11/90

(58) Field of Classification Search ..... None
See application file for complete search history.

(56) References Cited

U.S. PATENT DOCUMENTS

| | | | | | |
|---|---|---|---|---|---|
| D250,100 | S | * | 10/1978 | Finker et al. | D11/90 |
| D521,409 | S | * | 5/2006 | De Castro et al. | D11/90 |
| D544,391 | S | * | 6/2007 | Winkler | D11/90 |
| D567,139 | S | * | 4/2008 | Rydlewicz | D11/90 |
| D567,140 | S | * | 4/2008 | Rydlewicz | D11/90 |
| 2003/0221452 | A1 | * | 12/2003 | Morbidoni | 63/26 |

* cited by examiner

*Primary Examiner* — Jack W. Lavinder
(74) *Attorney, Agent, or Firm* — Baker Hostetler LLP

(57) ABSTRACT

A triangular shaped diamond adapted to display a hearts and arrows pattern when exposed to light comparable to the hearts and arrows pattern in a round diamond, comprising: six main crown facets, twelve crown half facets, a table facet, six main pavilion facets and a plurality of girdle facets separating the crown facets from the pavilion facets with each main crown facet having a symmetrically positioned opposite crown facet of substantially equal size surrounding the table facet and having at least one edge in parallel alignment with a corresponding edge in the main crown facet opposite thereto.

13 Claims, 6 Drawing Sheets

TRIANGULAR SHAPED DIAMOND WHICH DISPLAYS HEARTS AND ARROWS PATTERN

FIELD OF THE INVENTION

The present invention relates to the field of cut diamonds and more particularly to a diamond cut into a triangular shape adapted to generate a hearts and arrows pattern comparable and substantially equivalent to the hearts and arrows pattern generated by an ideal round cut diamond when exposed to light.

BACKGROUND OF THE INVENTION

A hearts and arrows pattern was successfully developed for a round shaped diamond when possessing a nearly perfect round shape having symmetrical and equal cut facets polished to satisfy the following requirements for its cut facets, angle parameters and alignment relationships:

The shape of the diamond must be perfectly symmetrical 8 main crown and 24 subsidiary crown facets 8 main bottom and 16 subsidiary bottom facets All main facets (crown & bottom) have to be polished at a perfect 45° angle to each other All facets are perfectly aligned All the bottom main facets are of equal size and at an angle ranging from 40.6°-41.0°

All the bottom subsidiary facets are of equal size and at an angle which is exactly 1.2° steeper than the main facets (main bottom angle 40.6°-41.0°+subsidiary 41.8°-42.2°)

All the main crown facets are of equal size and at an angle ranging from 33.8°-35.1°. They have to be perfectly aligned on the main bottom facets.

All the subsidiary crown facets are of equal size and perfectly aligned on the main crown and subsidiary bottom facets and polished at an equal angle.

The ideal proportions for the round cut diamond are:

total depth 59.4%-62.4% crown height 14.5%-16.0% girdle thickness 1.5%-2.95%

Roundness 99.0%-100%

Table size: 53.0%-57.5%

Although diamonds are typically cut into many geometrical shapes other than round such as, for example, a heart shape, oval, pear, marquis, princess, emerald, etc., only the round cut diamond has a nearly perfect symmetrical shape and can be polished to provide perfectly equal and symmetrical facets. Accordingly, in the diamond industry, it is widely believed that it is impossible to obtain a true hearts and arrows pattern in a non-symmetrically shaped diamond. Interestingly, what is common to all of the above shaped diamonds, other than the round shape, is its asymmetry. Moreover, if one follows the traditional method used in the diamond industry, of positioning the facets in line with the shape of the diamond, a true hearts and arrows pattern will indeed not be realizable.

It was discovered in accordance with the subject invention that a true hearts and arrows pattern can be generated in an asymmetrical shaped diamond including a triangular geometry consistent with and substantially equivalent to the hearts and arrows pattern generated in an ideal round cut diamond.

A traditional triangular shaped diamond is cut to form facets in line with the shape of the diamond and does not yield a hearts and arrows pattern. The traditional triangle cut has the following facets:

15 girdle facets
3 main crown facets
9 crown star facets
12 crown half facets
1 table facet
3 main pavilion facets
12 pavilion half facets
Total number of facets: 55

SUMMARY OF THE INVENTION

The triangular shaped diamond of the present invention possesses a heretofore unknown faceting pattern which yields a hearts an arrows pattern substantially equivalent to the hearts and arrows pattern in a round diamond. It is essential to the faceting pattern in the present invention that each main crown facet and each pavilion facet have an opposite symmetrically disposed facet with each of the main crown facets having at least one edge in parallel alignment. This is accomplished in accordance with the present invention by polishing the diamond to form multiple facets having a symmetrical alignment comprising: six main crown facets, twelve crown half facets, a table facet, six main pavilion facets and a plurality of main girdle facets, preferably three, separating the crown facets from the pavilion facets with each main crown facet having a symmetrically positioned opposite facet surrounding the table facet and having at least one edge in parallel alignment with a corresponding edge in the main crown facet opposite thereto. Moreover, the triangular shaped diamond of the present invention should also preferably include twelve pavilion half facets having two pavilion half facets polished on each main pavilion facet. In addition, the triangular shaped diamond of the present invention may further comprise three crown star facets, six subsidiary girdle facets and three optional subsidiary pavilion facets. The total number of facets without the subsidiary pavilion facets is 49 and the total number of facets with the subsidiary pavilion facets included is 52.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

Figures 1A, 1B, 1C:
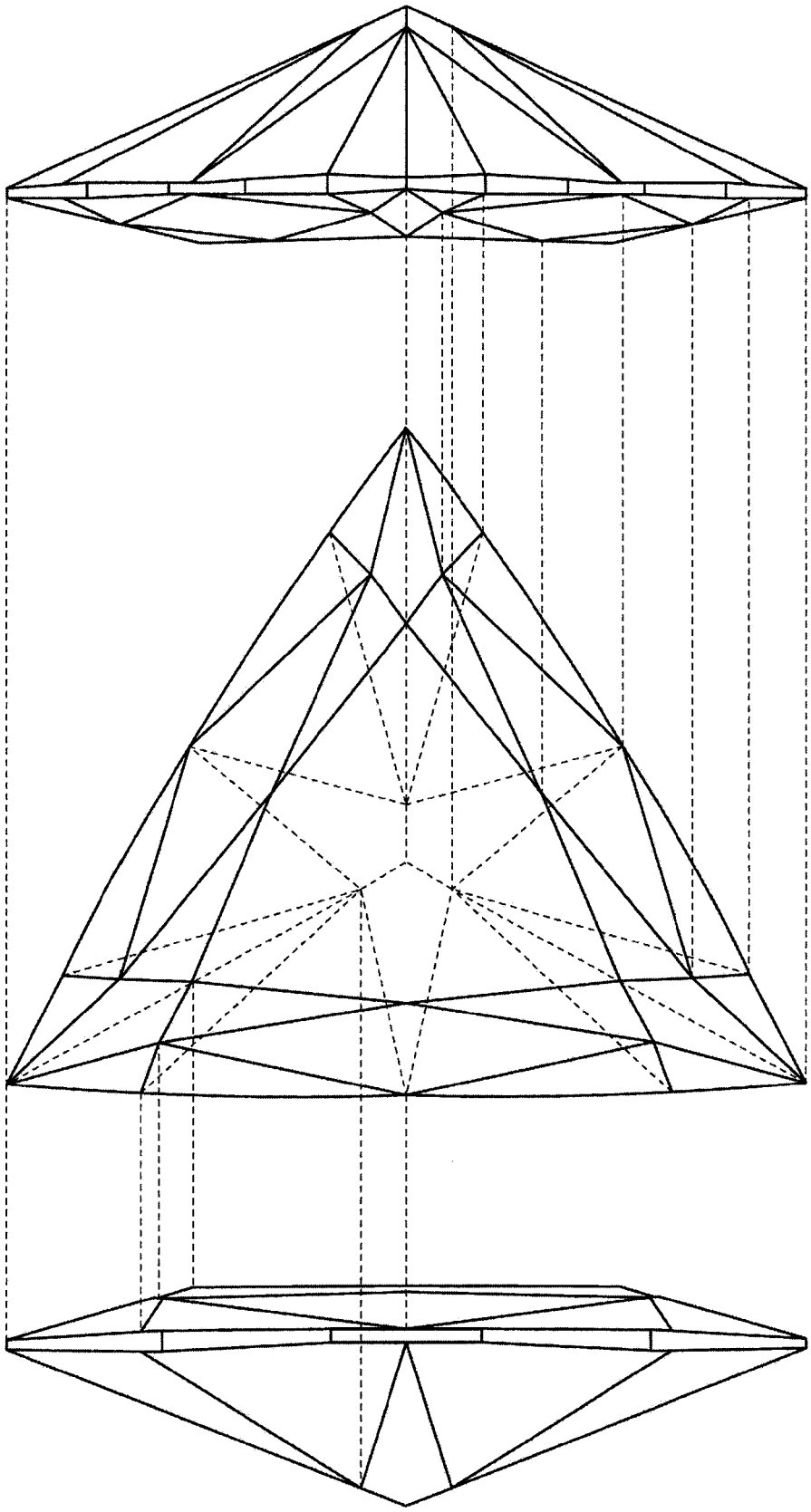
FIG. 1A (Prior Art)
FIG. 1B (Prior Art)
FIG. 1C (Prior Art)
FIG. 1A is a profile view of a traditional triangle diamond cut.
FIG. 1B is a table view of the traditional triangle diamond cut of FIG. 1A with dotted lies to show the faceting alignment between the crown side facets and the pavilion side facets.
FIG. 1C is an upside down view of the profile of the traditional triangle diamond cut shown in FIG. 1A with dotted lines to show additional faceting alignment with the pavilion side facets.
Figure 2:
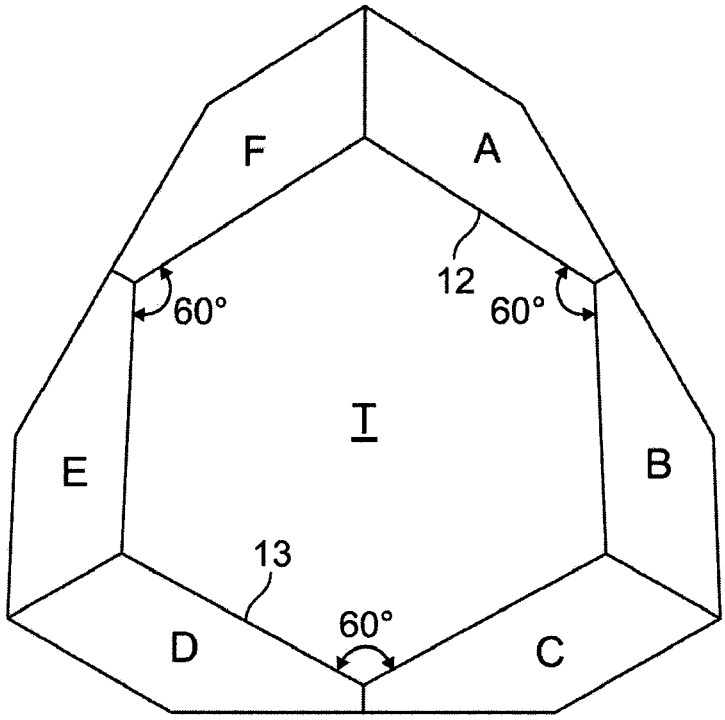
FIG. 2 is a top view of the triangular shaped diamond of the present invention showing the symmetrical arrangement of the six main crown facets with each main crown facet having an opposite parallel main crown facet.

A diamond is a crystal which functions as a prism for dispersing light by means of reflection and refraction. A traditional cut triangular diamond is shown in FIGS. 1A-1C and possesses three main crown facets and three main pavilion facets with the facets positioned in line with the shape of the diamond. In sharp contrast, the triangular shaped diamond of the present invention 10 is cut, as is shown in FIGS. 2-10 and more specifically as shown in FIG. 2, to form six main crown facets identified by the letters: A, B, C, D, E and F with each of the six main crown facets having a substantially equal and oppositely positioned facet and with at least one edge in each main crown facet having a corresponding edge in parallel alignment in the oppositely positioned main crown facet. For example, facet A lies opposite facet D with each of the facets A and D having parallel edges 12 and 13. The six main crown facets A through F surround a table facet T.

Figure 5:
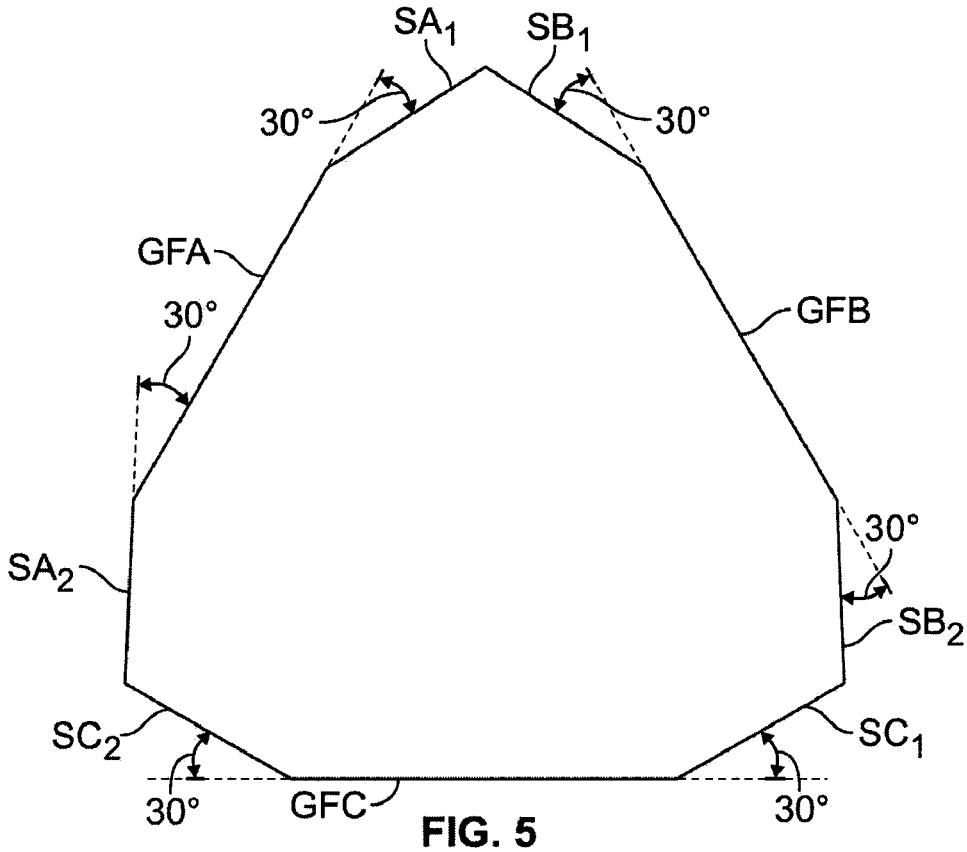
FIG. 5 is a top view of the triangular shaped diamond of the present invention showing the arrangement between the three main girdle facets and the six subsidiary girdle facets.

The triangular shaped diamond 10 should include three main girdle facets GFA, GFB and GFC and six subsidiary girdle facets $SA_1$, $SA_2$, $SB_1$, $SB_2$, $SC_1$, $SC_2$ respectively. FIG. 5 is a top view of the triangular shaped diamond 10 showing the arrangement between the three main girdle facets GFA, GFB and GFC and the six subsidiary girdle facets $SA_1$,$SA_2$, $SB_1$,$SB_2$, $SC_1$,$SC_2$. The six main crown facets A-F are preferably polished on the diamond 10 after the table area is polished into a smooth table facet T and in parallel alignment to the six subsidiary girdle facets $SA_1$,$SA_2$, $SB_1$,$SB_2$, $SC_1$, $SC_2$. However, the subsidiary girdle facets $SA_1$,$SA_2$, $SB_1$, $SB_2$, $SC_1$,$SC_2$ are not in alignment with the main girdle facets GFA, GFB and GFC. This permits the six main crown facets A-F to be polished with each main crown facet having a substantially identical and parallel opposite main crown facet. Moreover, the six main crown facets A-F should be polished within an angle degree range of 33.8°-35.2°. The subsidiary girdle facets $SA_1$ and $SA_2$ should preferably be polished at 30° from the main girdle facet GFA with the subsidiary girdle facets $SB_1$ and $SB_2$ polished at 30° from the main girdle facet GFB and the subsidiary girdle facets $SC_1$ and $SC_2$ polished at 30° from the main girdle facet GFC.

Figure 3:
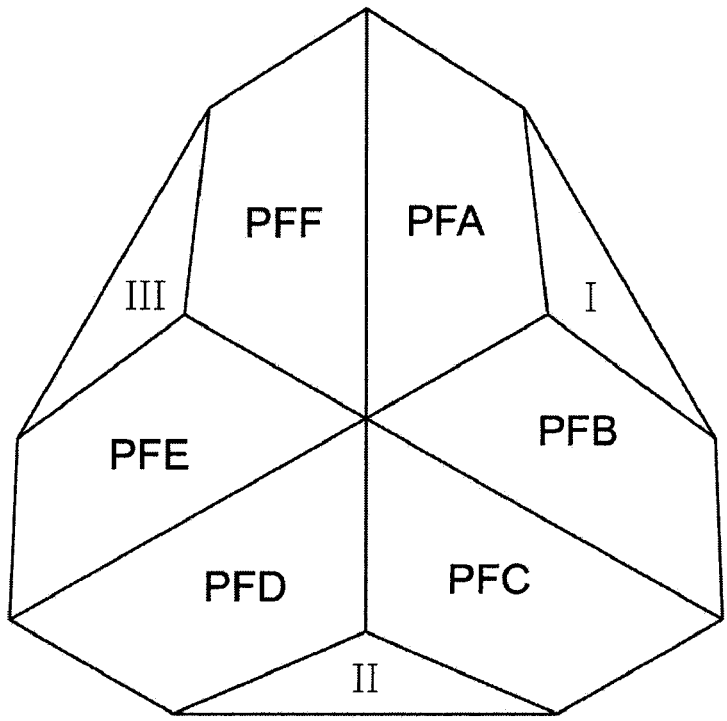
FIG. 3 is a pavilion or bottom view of the triangular shaped diamond of the present invention showing six main pavilion facets in an arrangement with three subsidiary pavilion facets.
Figure 4:
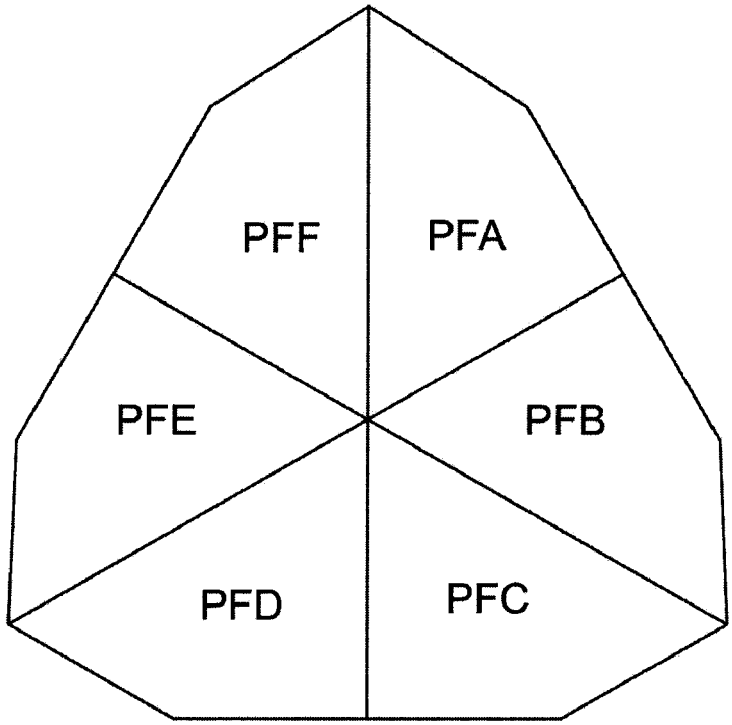
FIG. 4 is a pavilion or bottom view of the triangular shaped diamond of the present invention similar to FIG. 3 but without any subsidiary pavilion facets.

The triangular shaped diamond 10 should include six main pavilion facets PEA, PFB, PFC, PFD, PFE and PFF in an arrangement with three subsidiary pavilion facets I, II and III as shown in FIG. 3 or without any subsidiary pavilion facets as shown in FIG. 4. The three subsidiary pavilion facets are optional and should preferably be included when the diamond to be cut is a thick diamond as opposed to a relatively thin diamond. Each of the six main pavilion facets PFA-PFF are polished at 60° from each adjacent main pavilion facet and should each be aligned with the six main crown facets A-F and the six subsidiary girdle facets $SA_1$,$SA_2$, $SB_1$,$SB_2$, $SC_1$,$SC_2$ respectively. Accordingly, the main pavilion facet PFA should be polished at 60° from facet PFB and facet PFB should be polished at 60° from facet PFC etc. When the three subsidiary pavilion facets are included in the triangular shaped diamond 10 they should be aligned parallel to the three main girdle facets within an angle degree range of 65°-72°.

Figure 6:
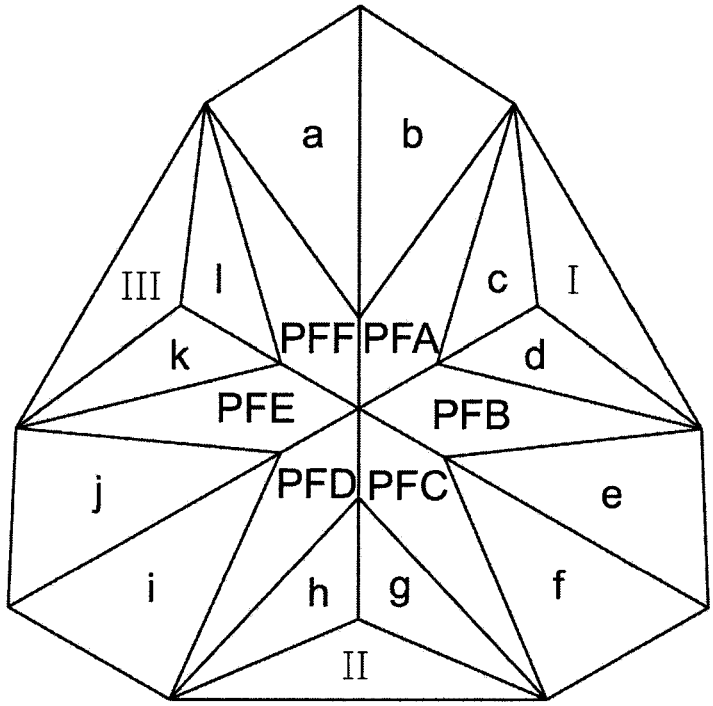
FIG. 6 is a pavilion or bottom view of the triangular shaped diamond of the present invention showing twelve pavilion half facets and three subsidiary pavilion facets of FIG. 3 in an arrangement with the six main pavilion facets.
Figure 7:
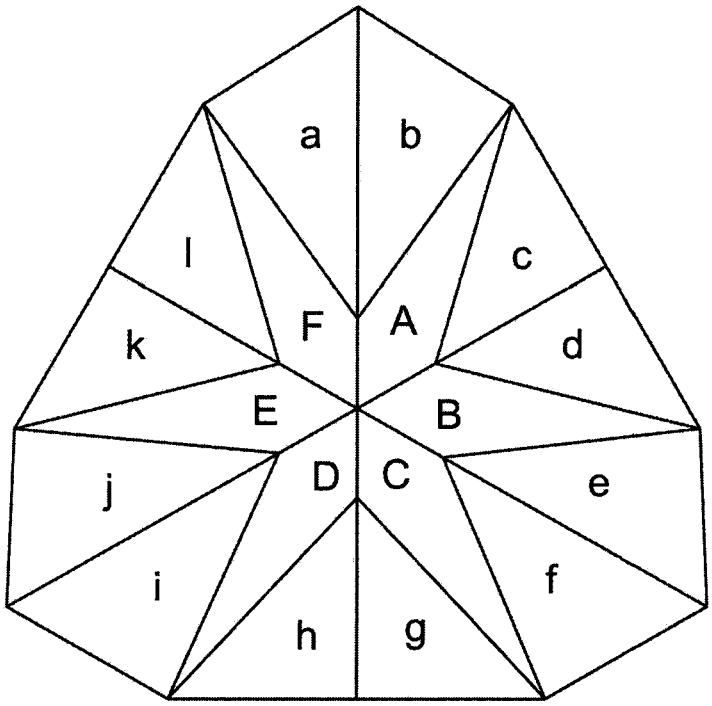
FIG. 7 is a pavilion or bottom view of the triangular shaped diamond of the present invention similar to FIG. 6 but without any subsidiary pavilion facets.
Figure 8:
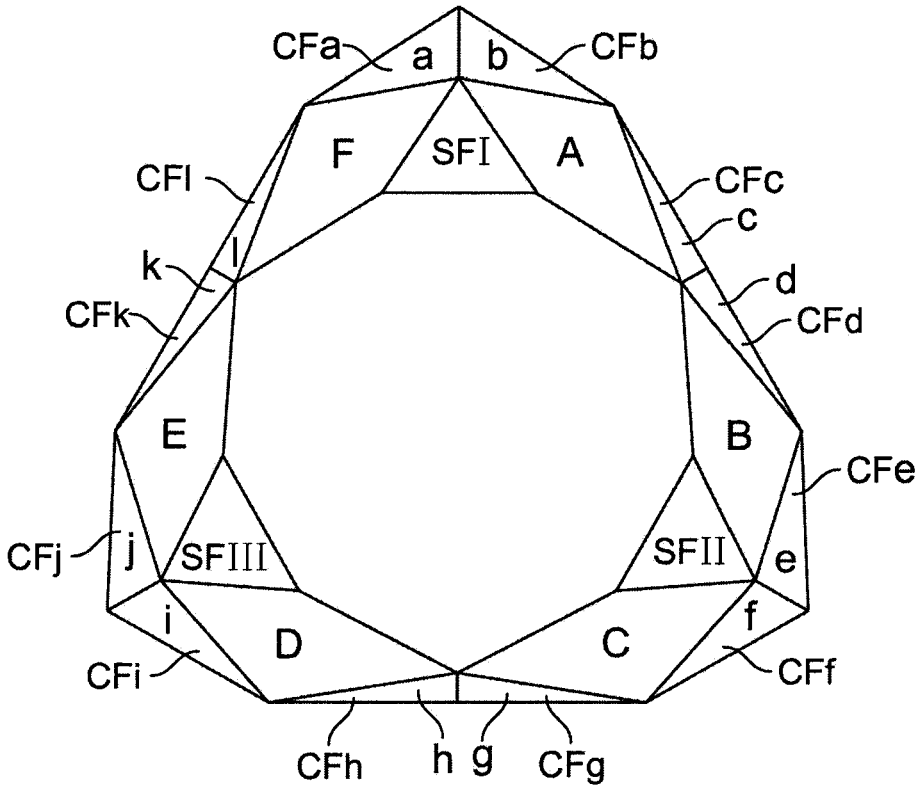
FIG. 8 is a top view of the triangular shaped diamond of the present invention similar to FIG. 2 showing the arrangement between the six main crown facets and the crown star facets and crown half facets surrounding the table facet.
Figure 9:
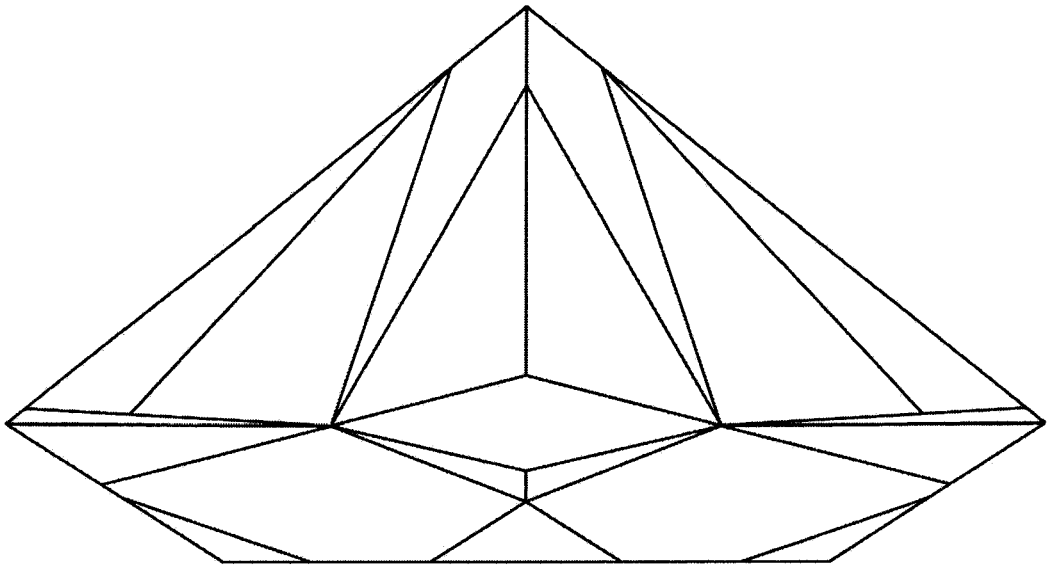
FIG. 9 is a side profile view of the triangular shaped diamond of the present invention without subsidiary pavilion facets.
Figure 10:
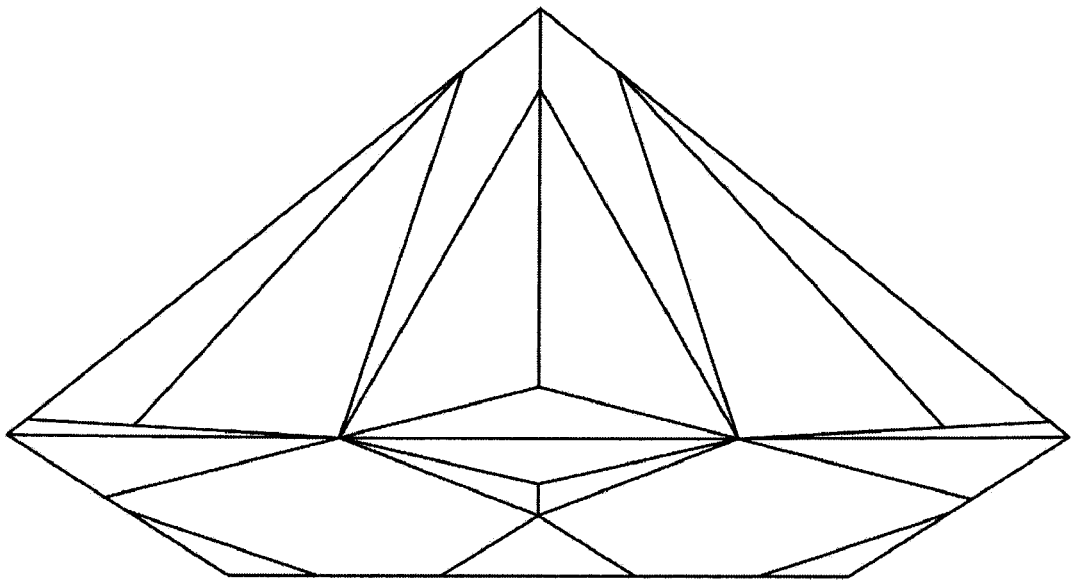
FIG. 10 is another side profile view of the triangular shaped diamond of the present invention with subsidiary pavilion facets.

The triangular shaped diamond 10 should include twelve pavilion half facets identified by the letters: a, b, c, d, e, f, g, h, i, j, k and l respectively. Each pavilion half facet should preferably be polished within an angle degree range of 41.9°-42.9°. The twelve pavilion half facets (a-l) are shown in an arrangement with the six main pavilion facets (PFA-PFF) and with the three subsidiary pavilion facets (I, II, III) in FIG. 6 and without any subsidiary pavilion facets in FIG. 7. All of the twelve pavilion half facets a-l should preferably be polished to an identical angle and should preferably meet adjacent pavilion half facets at a point. In addition, the six pavilion half facets a, b, e, f, i and j should each preferably be polished to within a depth range of 42.4°-49.2° depending upon the stone's total depth whereas the other six pavilion half facets c, d, g, h, k and l should each preferably be polished within the depth range of 40.8°-42.8°. However, when the triangular shaped diamond 10 includes the three subsidiary pavilion facets (I, II, III) the pavilion half facets c-l have a lower depth range because of the presence of the three subsidiary pavilion facets (I, II, III) as shown in FIG. 6 than in the counterpart arrangement without any subsidiary pavilion facets as shown in FIG. 7.

The triangular shaped diamond 10 should also include three crown star facets SF1, SF11 and SF111 respectively within an angle degree range of 18.6°-24.2° and twelve crown half facets CFa, CFb, CFc, CFd, CFe, CFf, CFg, CFh, CFi, CFj, CFk and CFl respectively. It should be noted that it is unusual to have an unequal number of crown star facets relative to the number of main crown facets. However, it was discovered that having star facets on the main girdle sides distorts light refraction. It should also be noted that it is preferable for each of the six crown half facets CFa, CFb, Cfe, CFf, Cfi and CFj to be polished within an angle degree range of 37.0°-40.4° while each of the other six crown half facets CFc, CFd, CFg, CFh, CFk and Cfl are polished at an angle degree range of 48.0°-50.8°.

The triangular shaped diamond of the present invention will yield a hearts and arrows pattern substantially equivalent to the hearts and arrows pattern of the round cut when cut to satisfy the optimum parameters set forth below in Table I:

TABLE I

| | |
|---|---|
| Total Depth: | 59.6%-65.6% |
| Table size | 53.2%-65.4% |
| Pavilion Depth | 42.2%-49.2% |
| Crown Height | 12.8%-16.4% |
| Crown angle | 33.8°-35.2° |
| Pavilion angle | 40.6°-41.1° |
| Subsidiary pavilion facets | 65.0%-75.0% |
| Crown Halves on main girdles | 38.0°-51.2° |
| Crown Halves on subsidiary girdles | 37.0°-40.4° |
| Crown star facets | 16.0°-24.2° |
| Depth of pavilion half facets on main girdle side | 40.8%-42.8% |

TABLE I-continued

| | |
|---|---|
| Depth of pavilion half facets on subsidiary girdles | 42.4%-49.2% |
| Pavilion half angle degree range | 41.8%-42.9% |

The diamond should be measured repeatedly as to insure the cut parameters are obtained. The angles and dept size should be verified for accuracy using conventional analyzers.

What is claimed is:

1. A triangular shaped diamond adapted to display a hearts and arrows pattern when exposed to light comparable to the hearts and arrows pattern in a round diamond, having six main crown facets, twelve crown half facets, a table facet, six main pavilion facets and a plurality of girdle facets separating the crown facets from the pavilion facets with each of the six main crown facet having a symmetrically positioned and substantially identical opposite crown facet of substantially equal size and angle degree surrounding the table facet and having at least one edge in parallel alignment with a corresponding edge in the main crown facet opposite thereto, wherein said plurality of girdle facets comprises three main girdle facets and six subsidiary girdle facets and wherein the main crown facets are in parallel alignment with a subsidiary girdle facet and each of the six main pavilion facets are aligned with the six main crown facets and the six subsidiary girdle facets respectively.

2. A triangular shaped diamond as defined in claim 1 wherein each main pavilion facet is of substantially equal size and has a symmetrically positioned opposite pavilion facet.

3. A triangular shaped diamond as defined in claim 1 wherein said six subsidiary girdle facets are not in alignment with the main girdle facets.

4. A triangular shaped diamond as defined in claim 3 wherein each main girdle facet has two subsidiary girdle facets adjacent thereto on opposite sides thereof with each of said two subsidiary girdle facets polished at an angle of 30° from the adjacent main girdle facet.

5. A triangular shaped diamond as defined in claim 3 wherein each of the six main crown facets are polished within an angle degree range of 33.8°-35.2°.

6. A triangular shaped diamond as defined in claim 3 wherein each of the six main pavilion facets are polished at 60° from each adjacent main pavilion facet.

7. A triangular shaped diamond as defined in claim 6 further comprising three subsidiary pavilion facets aligned parallel to the three main girdle facets.

8. A triangular shaped diamond as defined in claim 3 further comprising twelve pavilion half facets.

9. A triangular shaped diamond as defined in claim 8 wherein the twelve pavilion half facets are each polished to an identical angle within an angle degree range of 41.9°-42.9° with respect to the main pavilion facets.

10. A triangular shaped diamond as defined in claim 8 wherein the pavilion half facets which lie adjacent subsidiary pavilion facets are each polished with respect to the main pavilion facets to within a depth range of 40.8°-42.8° and wherein other pavilion half facets which do not lie adjacent a subsidiary pavilion facet are each polished with respect to the main pavilion facets to within a depth range of 42.4°-49.2°.

11. A triangular shaped diamond as defined in claim 3 further comprising three crown star facets.

12. A triangular shaped diamond as defined in claim 11 wherein the three crown star facets are each polished within an angle degree range of 18.6°-24.2° relative to the table facet.

13. A triangular shaped diamond as defined in claim 11 further comprising twelve crown half facets with each of the crown half facets in contact with a crown star facet polished within an angle degree range of 37.0°-40.4° relative to the table facet and with each of the crown half facets which do not contact a crown star facet are polished at an angle degree range of 48.0°-50.8° relative to the table facet.

* * * * *